US009803848B2

(12) United States Patent
Van Hout

(10) Patent No.: US 9,803,848 B2
(45) Date of Patent: Oct. 31, 2017

(54) LED ELECTRIC BULB AND THE MANUFACTURING THEREOF

(71) Applicant: PHILIPS LIGHTING HOLDING B.V., Eindhoven (NL)

(72) Inventor: Johannes Antonius Maria Van Hout, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 38 days.

(21) Appl. No.: 15/023,114

(22) PCT Filed: Sep. 16, 2014

(86) PCT No.: PCT/EP2014/069645

§ 371 (c)(1),
(2) Date: Mar. 18, 2016

(87) PCT Pub. No.: WO2015/039999

PCT Pub. Date: Mar. 26, 2015

(65) Prior Publication Data

US 2016/0230939 A1 Aug. 11, 2016

(30) Foreign Application Priority Data

Sep. 19, 2013 (EP) ..... 13185125

(51) Int. Cl.
*F21V 23/00* (2015.01)
*F21V 29/70* (2015.01)
(Continued)

(52) U.S. Cl.
CPC ..... *F21V 29/70* (2015.01); *F21K 9/1355* (2013.01); *F21K 9/232* (2016.08); *F21K 9/238* (2016.08);
(Continued)

(58) Field of Classification Search
CPC ..... F21V 29/70; F21V 29/86; F21V 3/0418; F21V 23/006; F21V 23/04; F21V 25/02;
(Continued)

(56) References Cited

U.S. PATENT DOCUMENTS 6,523,978 B1 * 2/2003 Huang ..... F21V 3/00 313/500
2003/0031015 A1 * 2/2003 Ishibashi ..... F21V 3/00 362/235
(Continued)

FOREIGN PATENT DOCUMENTS

EP 2339223 A1 6/2011
EP 2392850 A1 12/2011
(Continued)

*Primary Examiner* — Alexander Garlen
(74) *Attorney, Agent, or Firm* — Akarsh P. Belagodu

(57) ABSTRACT

The invention relates to a LED electric bulb (1) and a method of producing a LED electric bulb. The LED electric bulb (1) comprises a glass bulb (2), a cap (6) and a light generating module (17). The light generating module (17) is at least partly received inside the glass bulb (2) and is arranged in electrical contact with the cap (6). The light generating module (17) comprises a driver PCB (3) and a flexible, double folded strip (4) forming two opposite legs (14) comprising a plurality of LED's (5). The flexible, double folded strip (4) is arranged to conform to and closely contact at least a portion of the interior surface (15) of the glass bulb (2). The invention also relates to a semi-finished LED electric bulb and the use thereof for the production of a LED electric bulb.

12 Claims, 10 Drawing Sheets

(51) Int. Cl.

| | |
|---|---|
| ***F21V 25/02*** | (2006.01) |
| ***F21K 9/90*** | (2016.01) |
| ***F21K 9/232*** | (2016.01) |
| ***F21V 29/85*** | (2015.01) |
| ***F21K 99/00*** | (2016.01) |
| ***F21V 3/04*** | (2006.01) |
| ***F21V 23/04*** | (2006.01) |
| ***F21V 25/04*** | (2006.01) |
| ***F21K 9/238*** | (2016.01) |
| *F21Y 101/02* | (2006.01) |
| *F21Y 111/00* | (2016.01) |
| *F21Y 115/10* | (2016.01) |
| *F21Y 107/20* | (2016.01) |

(52) U.S. Cl.
CPC ..... *F21K 9/90* (2013.01); *F21V 3/0418* (2013.01); *F21V 23/006* (2013.01); *F21V 23/04* (2013.01); *F21V 25/02* (2013.01); *F21V 25/04* (2013.01); *F21V 29/86* (2015.01); *F21Y 2101/02* (2013.01); *F21Y 2107/20* (2016.08); *F21Y 2111/001* (2013.01); *F21Y 2115/10* (2016.08)

(58) Field of Classification Search
CPC ..... F21V 25/04; F21K 9/238; F21K 9/232; F21K 9/1355; F21K 9/90
See application file for complete search history.

(56) References Cited

U.S. PATENT DOCUMENTS

| | | | | |
|---|---|---|---|---|
| 2004/0008525 | A1 | 1/2004 | Shibata | |
| 2005/0207152 | A1* | 9/2005 | Maxik | F21K 9/90 362/231 |
| 2009/0026982 | A1 | 1/2009 | Lee et al. | |
| 2011/0163683 | A1* | 7/2011 | Steele | F21V 7/00 315/192 |
| 2012/0146513 | A1* | 6/2012 | Radermacher | F21V 25/04 315/119 |
| 2012/0169251 | A1* | 7/2012 | Lai | F21K 9/90 315/294 |
| 2012/0170288 | A1* | 7/2012 | Lai | F21K 9/90 362/373 |
| 2013/0070457 | A1 | 3/2013 | Nishiuchi et al. | |
| 2014/0268771 | A1* | 9/2014 | Heikman | F21V 29/004 362/249.02 |
| 2014/0355261 | A1* | 12/2014 | Dingemans | F21V 25/04 362/217.17 |

FOREIGN PATENT DOCUMENTS

| | | | |
|---|---|---|---|
| EP | 2392851 | A | 12/2011 |
| EP | 2472169 | A2 | 7/2012 |
| EP | 2472170 | A2 | 7/2012 |
| FR | 2908500 | A1 | 5/2008 |
| KR | 2011070261 | A | 6/2011 |
| WO | WO2005090852 | A2 | 9/2005 |
| WO | WO2011054819 | A1 | 5/2011 |
| WO | WO2012115884 | A1 | 8/2012 |

* cited by examiner

LED ELECTRIC BULB AND THE MANUFACTURING THEREOF

CROSS-REFERENCE TO PRIOR APPLICATIONS

This application is the U.S. National Phase application under 35 U.S.C. §371 of International Application No. PCT/EP2014/069645, filed on Sep. 16, 2014, which claims the benefit of European Patent Application No. 13185125.5, filed on Sep. 19, 2013. These applications are hereby incorporated by reference herein.

FIELD OF THE INVENTION

The invention relates to a method of manufacturing a LED electric bulb, a semi-finished LED electric bulb, the use of such semi-finished LED electric bulb and a LED electric bulb.

BACKGROUND OF THE INVENTION

Incandescent lamps offer the advantage of being cheap to produce since the production method used is mature and fully automated. Incandescent lamps do however have a large quantity of generated heat, a high power consumption and a short life. In the constant striving towards new technologies providing a lower power consumption it is therefore interesting to find suitable replacements. This is especially the case since the production of incandescent lamps recently has been limited or even stopped due to its inefficient energy consumption.

One alternative to the incandescent lamp is the LED based lamp. The LED based lamp has a small quantity of generated heat, a low power consumption and a long life. Compared to incandescent lamps, which parts are mature and cheap due to fully automated manufacturing processes, LED based lamps and their parts are still evolving as their design and way of assembly is not yet mature and also the volumes are so far not very high. This makes the parts relatively expensive and also urges manual assembly to low labor regions with a complex supply chain with long lead times. There is a tendency that the LED based lamps are designed around the LED source. Further, a LED based lamp does in general consist of more parts to assemble as compared to incandescent lamps. While a incandescent lamp consist of a burner stem with a tungsten filament, a glass bulb and a cap, a typical LED based lamp consists of a plurality of LED's on a PCB (printed circuit board), a driver to feed the LED's, a heatsink to limit the LED temperature, a housing, a plastic bulb, screws and a cap.

Also, a plurality of LED's are required to provide the required light quantity. The LED's are typically arranged on a driver PCB and the number of LED's are adapted to the wanted light quantity. This is however problematic when assembling the driver PCB and the bulb since the opening of the bulb must be large enough to receive the driver PCB. There is also a problem of dissipating the heat generated by the LED's in order of ensuring an acceptable life time.

US2004/0008525 discloses one solution to this problem in which a LED chain body is formed by connecting a plurality of LED lamps via flexible members. The LED chain body is inserted into the bulb. The number of LED's in the chain body may be adapted to the desired quantity of light.

WO05/090852 discloses a lighting element comprising a housing with a substrate including a plurality of light emitting devices. The substrate, initially having a planar form, conforms to the inside wall of the housing when inserted therein. Standoffs are provided between the substrate and the inside wall to provide a desired light dispersion.

SUMMARY OF THE INVENTION

It is an object of the present invention to provide a low cost method of producing a LED electric bulb and a semi-finished LED electric bulb wherein the number of parts may be reduced and wherein the uniaxial mounting method used for an incandescent lamp may be used.

Another object is that the bulb and the cap used for the incandescent lamp may be used.

Yet another object is to provide a LED electric bulb having good heat dissipating properties and thereby a long life time.

According to a first aspect of the invention, these and other objects are achieved by a method of producing a LED electric bulb, comprising: providing a light generating module comprising a driver PCB and a flexible, double folded strip forming two opposite legs comprising a plurality of LED's; providing a glass bulb having an open end; inserting the light generating module into the glass bulb via the open end thereof, with the flexible, double folded strip extending into the interior of the glass bulb, whereby the two opposite legs are pressed apart to conform to and closely contact at least a portion of the interior of surface of the glass bulb as the flexible, double folded strip is inserted into the glass bulb meeting the interior surface thereof; and providing a cap closing the open end of the glass bulb.

Thus, the invention provides for an uniaxial mounting of the glass bulb, the light generating module and the cap, whereby the manufacturing of the LED electrical bulb is made as simple as that used for incandescent lamps. This allows the manufacturing cost to be reduced. By the double folded strip being arranged to conform to and contact at least a portion of the interior surface of the glass bulb, the heat generated by the LED's during use will be effectively dissipated by the glass bulb. Glass generally has a better dissipation capacity than e.g. plastics material. Since the glass bulb can be seen as a heatsink there is no longer any need for a separate heatsink. This allows an enhanced lifetime and fewer parts. In fact a thermal management is made possible wherein the maximum temperature of the LED's is within the specification for a sufficient lifetime while still delivering enough lumen to compete with incandescent lamps with a range of 200-1600 lumen.

The light generating module may before or during insertion into the glass bulb have a cross section smaller than the cross section of the open end of the glass bulb. Thereby the light generating module may be provided as a separate module for later uniaxial mounting to a bulb.

The cap may be provided to close the open end of the glass bulb by engaging a ring on the light generating module. The ring forms a closing means, but it may also form an air-/gas tight sealing in case the glass bulb should be provided with dry air or an inert gas to prevent moisture or gas to enter the interior of the lamp.

By the flexible, double folded strip forming two opposite legs which are pressed apart to conform to and closely contact at least a portion of the interior of surface of the glass bulb as the flexible, double folded strip is inserted into the glass bulb meeting the interior surface thereof, the inherent flexible properties of the strip are used to provide an intimate contact between the LED's and the glass bulb to enhance heat dissipation.

According to another aspect, the invention relates to a method of producing a semi-finished LED electric bulb, comprising providing a flexible, double folded strip forming two opposite legs comprising a plurality of LED's; providing a glass bulb having an open end; and inserting the flexible, double folded strip into the glass bulb via the open end thereof, whereby the two opposite legs are pressed apart to conform to and closely contact at least a portion of the interior of surface of the glass bulb as the flexible, double folded strip is inserted into the glass bulb meeting the interior surface thereof.

The semi-finished LED electric bulb according to the invention provides for a uniaxial mounting of the glass bulb and the flexible, double folded strip. Further, the semi-finished LED electric bulb may be produced at one site for later assembly to form a LED electric bulb at another site.

According to yet another aspect, the invention relates to the use of a semi-finished LED electric bulb according to the description above for the production of a LED electric bulb.

According to still another aspect, the invention relates to a LED electric bulb, comprising a glass bulb, a cap and a light generating module at least partly received inside the glass bulb and being in electrical contact with the cap, wherein the light generating module comprises a driver PCB and a flexible, double folded strip forming two opposite legs comprising a plurality of LED's, whereby the two opposite legs are pressed apart and conforming to and closely contacting at least a portion of the interior of surface of the glass bulb.

As discussed above when discussing the method of manufacturing such LED electric bulb, the LED electric bulb may be mounted in an uniaxial mounting direction, whereby the manufacturing of the LED electrical bulb is made as simple as that used for incandescent lamps. This allows the manufacturing cost to be reduced. By the double folded strip being arranged to follow and contact at least a portion of the interior surface of the glass bulb, the heat generated by the LED's during use will be dissipated by the glass bulb. This allows an enhanced lifetime. Since the glass bulb can be seen as a heatsink there is no need for any separate heatsink. In fact a thermal management is made possible wherein the maximum temperature of the LED's is within the specification for a sufficient lifetime while still delivering enough lumen to compete with incandescent lamps with a range of 200-1600 lumen.

The LED electric bulb may comprise a switch arrangement comprising a push-button switch arranged on the driver PCB and a needle extending between the push-button switch and an inner surface of the glass bulb. The switch arrangement provides as safety measure in case the glass bulb should break during use. Should the glass bulb break, the engagement between the needle and the push-button switch will be released whereby the power-supply to the LED's will be cut off. Accordingly, despite the disadvantage of breakable glass with respect to electrical safety when using a voltage driving the LED's which may be as high as 40V, the electrical safety can be guaranteed.

It is noted that the invention relates to all possible combinations of features recited in the claims.

BRIEF DESCRIPTION OF THE DRAWINGS

These and other aspects of the present invention will now be described in more detail, with reference to the appended drawings showing embodiments of the invention.

It should be stressed that the appended drawings are for illustrative purposes and, are thus provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
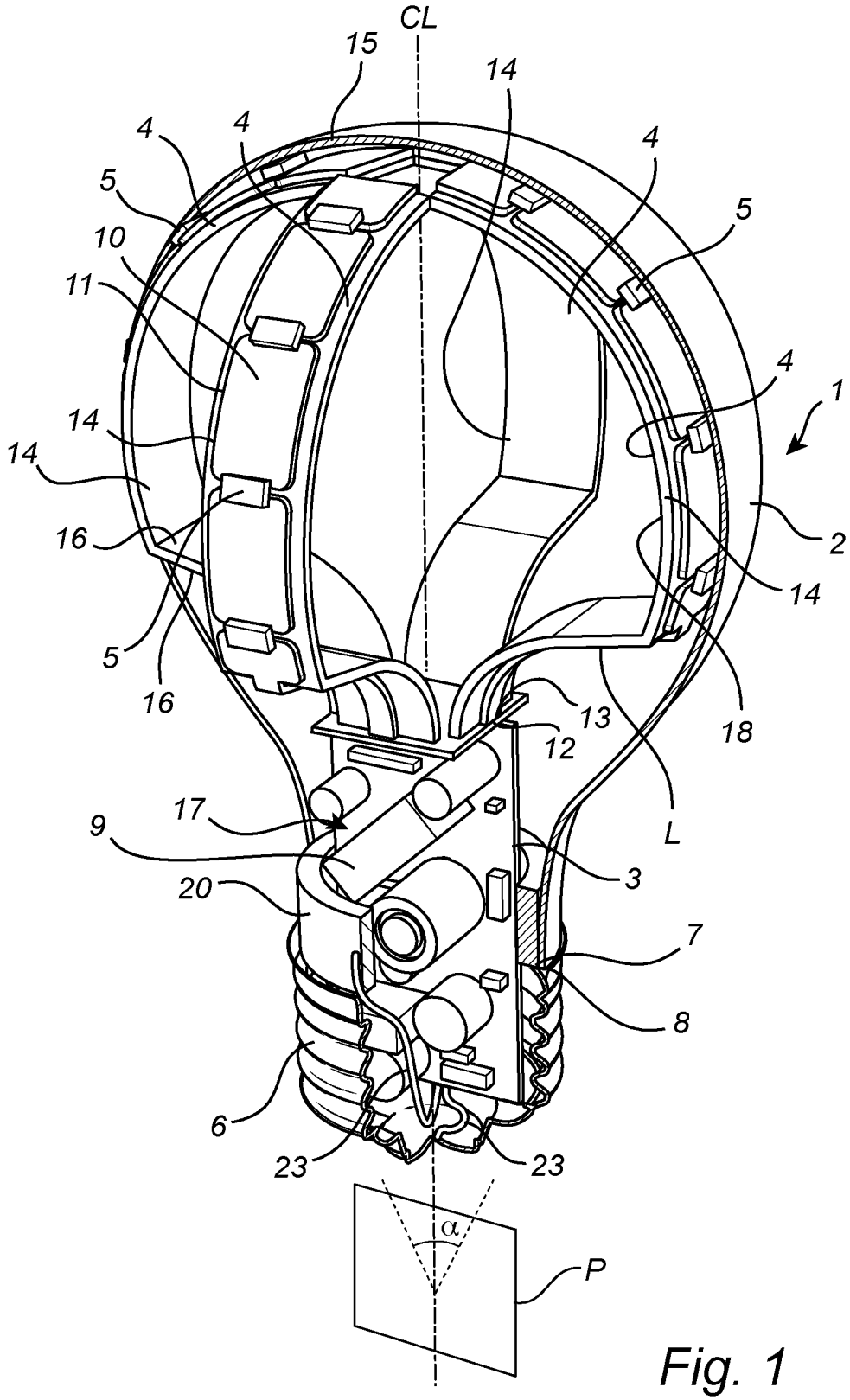
FIG. 1 discloses the overall design of a LED electric bulb according to the invention.

Referring to FIG. 1, the overall design of a LED electric bulb 1 according to the invention is disclosed. The LED electric bulb 1 comprises roughly three modules—a glass bulb 2, a driver PCB 3 comprising at least one flexible, double folded strip 4 supporting a plurality of LED's 5 and a cap 6. In FIG. 1 two flexible double folded strips 4 are arranged in a crisscross pattern.

The glass bulb 2 has the shape of a hollow dome shaped body with a tapered neck portion 7. The neck portion 7 defines an open end 8 of the glass bulb 2. It is to be understood that the glass bulb 2 may have virtually any shape and that the glass bulb 2 may be the same glass bulb as used for conventional incandescent lamps.

The driver PCB 3 comprises (highly schematically illustrated) electronic equipment 9 such as resistors, rectifying diods etc. necessary to drive and control the plurality of LED's 5 to be described below.

In the disclosed embodiment the driver PCB 3 has an essentially rectangular shape. Still it is to be understood that other geometries are possible. To allow insertion into the glass bulb 2 during mounting, the driver PCB 3 has a cross section being smaller than the diameter of the open end 8 of the glass bulb 2. In the disclosed embodiment the driver PCB 3 is oriented to extend in parallel with the longitudinal centerline CL of the LED electric bulb 1. It is however to be understood that also other orientations are possible, such as perpendicular to the longitudinal center line.

In the disclosed embodiment the flexible, double folded strip 4 comprising a plurality of LED's 5 is connected to the driver PCB 3. It is to be understood that the LED electric bulb 1 may comprise at least one flexible strip 4. In the disclosed embodiment the two flexible strips 4 are arranged in crisscross with a mutual angle of 90 degrees.

The plurality of LED's 5 are connected in series along the longitudinal extension of the flexible strip 4 via intermediate electrical contact zones 10 forming an electrical circuit 11.

Figure 8A:
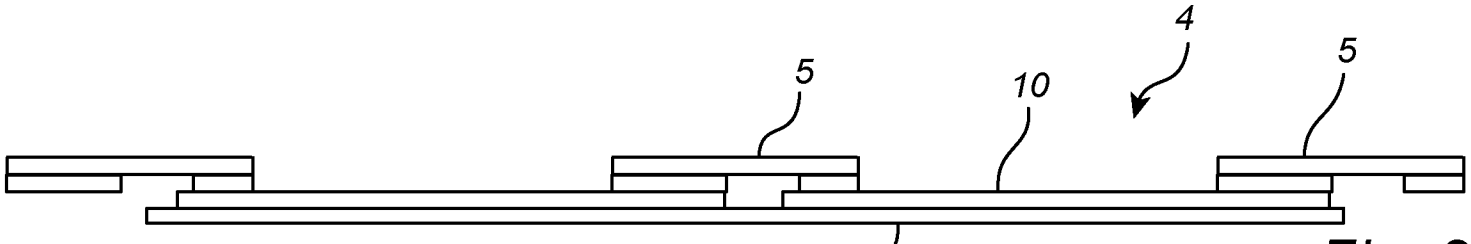
FIGS. 8*a* and 8*b* schematically disclose embodiments of the flexible strip.
Figure 8B:
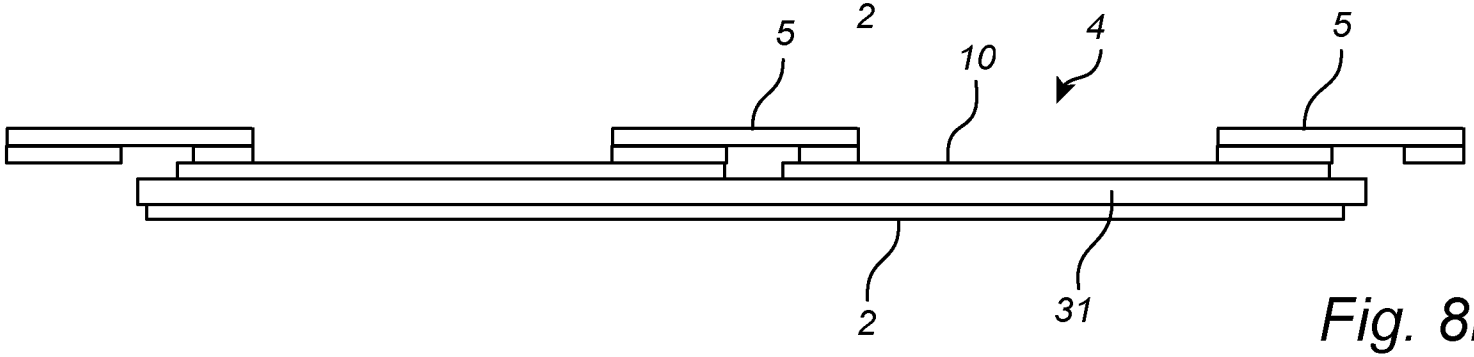

The flexible strip 4 may be formed by the electrical contact zones 10 forming a strip-shaped item supporting a plurality of LED's 5 as is shown in FIG. 8*a*. By arranging the electrical contact zones 10 as close as possible, and even in direct contact with the interior surface 15 of the glass bulb 2 when the flexible strip 4 is mounted inside the glass bulb 2 an effective heat dissipation may be provided for. The flexible strip 4 may also be formed by the electrical zones 10 and the plurality of LED's 5 being arranged on a supporting structure 31 as illustrated in FIG. 8*b*. The electrical circuit 11 may by way of example be embedded in the supporting structure 31. The supporting structure 31 may by way of example be a bendable plastic material allowing the strip to conform to the inner surface 15 of the glass bulb 2 when inserted into the glass bulb. In case a supporting structure 31 is used, it should be made as thin as possible in order of reducing added resistance to the heat flow. In the embodiments of FIGS. 8*a* and 8*b*, the flexible strip 4 is illustrated as directly contacting the interior surface of the glass bulb 2 via its intermediate contact zones 10. Thereby a very efficient heat dissipation is provided for.

The LED's 5 may be arranged in a regularly, equidistantly pattern or in any other pattern. The number of LED's 5 in each flexible strip 4 is adapted to the desired light to be provided by the LED electric bulb 1.

The flexible double folded strip 4 is connected via electrical contacts 12 with mating contacts 13 on the driver PCB 3.

By the double folded configuration, the flexible strip 4 forms two legs 14 and may be seen as a loop when connected to the driver PCB 3. The flexible, double folded strip 4 has a length exceeding the longitudinal extension of the glass bulb 2 as seen along the longitudinal centerline CL of the glass bulb 2. Further it has a width of 2-20 mm.

When inserting the flexible, double folded strip 4 into the glass bulb 2, the flexible strip 4 and its LED's 5 will meet the interior surface 15 of the dome shaped glass bulb 2 whereby the two legs 14 will be pressed apart and conform to and contact at least a portion of the interior surface 15 of the glass bulb 2. The flexible strips 4 will thus form a meridian like pattern on the interior surface 15 of the glass bulb 2.

The flexible strip 4 should follow and be in close contact with the interior surface 15 of the glass bulb 2. The distance between the flexible strip 4 and the interior surface 15 of the glass bulb 2 should be less than 0.20 mm and more preferred less than 0.1 mm. Thereby the material of the glass bulb 2 can dissipate the heat of the conductive zones 10 of the flexible strips 4, which heat is generated by the LED's 5. By dissipating the heat, the lifetime of the LED electric bulb 1 and the individual LED's 5 may be increased. Also, no separate heatsink is required since the glass bulb acts as a heatsink.

Given a wanted lumen level and lifetime of the LED electric bulb 1, the required power, the number of LED's 5 and the required dissipating power can be calculated. Combining this with the heat dissipating capacity of the flexible strip 4, the required conductive area, i.e. the width of the strip, the number of flexible strips 4 to be arranged in the glass bulb 2 and the number of LED's 5 arranged on each flexible strip 4 may be calculated.

It is preferred that each flexible strip 4 follows and is in contact with a portion of the interior surface 15 of the glass bulb 2 corresponding to an angle α of at least 90 degrees of the dome shaped geometry of the glass bulb 2 as seen in a plane P coinciding with the longitudinal centerline CL of the glass bulb 2. In the disclosed embodiment the flexible strip 4 has a length L conforming to and being in contact with a portion of the interior surface 15 of the glass bulb 2 corresponding to an angle α of about 200 degrees. The two legs 14 preferably extend like symmetrical meridians on both sides of the longitudinal centerline CL.

Figure 2A:
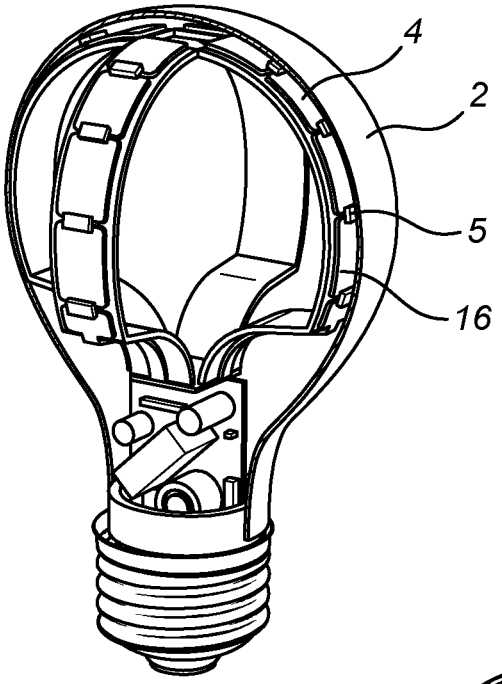
FIGS. 2*a* and 2*b* disclose examples of different positions of the LED's.
Figure 2B:
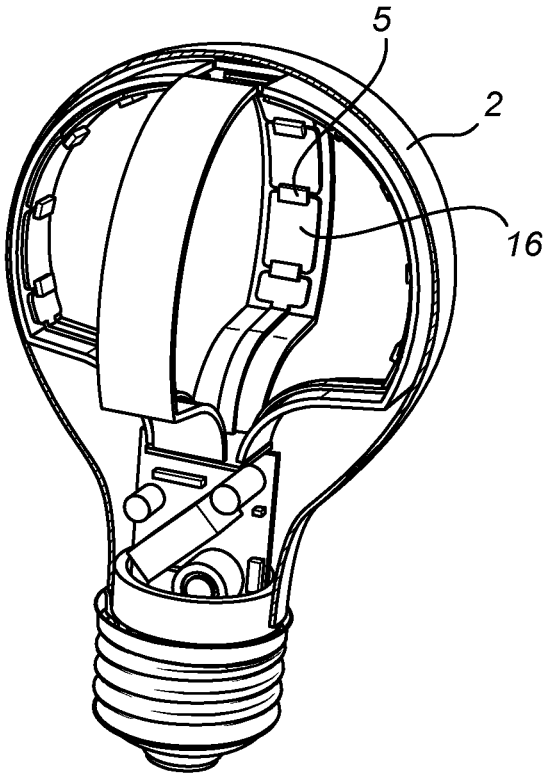

The flexible strip 4 may be provided with LED's 5 on one or on both major surfaces 16 thereof. In the embodiments of FIGS. 1 and 2*a* the flexible strip 4 is provided with LED's 5 on the major surface 16 facing away from the interior of the glass bulb 2. Such LED's 5 will emit light directly through the glass bulb 2. In case LED's 5 are arranged on the major surface 16 facing towards the interior of the glass bulb 2, see FIG. 2*b*, the LED's 5 will emit a light experienced by an eye as a less spottiness and a more diffuse light.

The flexibility of the strip 4 may be provided by the inherent flexibility of the strip as such. It is to be understood that the flexibility may be enhanced by locally thinner material thickness (not disclosed) forming flexible joint-like portions across the longitudinal extension of the flexible strip.

The LED's 5 on the flexible strip 4 may be connected in series, in parallel or in a combination thereof.

The driver PCB 3 together with the flexible, double folded strip 4 connected thereto forms a light generating module 17.

To allow insertion of the light generating module 17 into the glass bulb 2, the cross section of the light generating module 17 should at least during the step of insertion of the light generating module 17 into the glass bulb 2 be smaller than the cross section of the open end 8 of the glass bulb 2. One way of achieving this is that the driver PCB 3 and the flexible, double folded strip 4 before and during insertion has a cross section that is smaller than the open end 8 of the glass bulb 2 and that the flexible strip 4 expands to conform to and follow the interior surface 15 of the glass bulb 2 as the flexible strip 4 is pressed towards the interior surface 15 of the glass bulb 2 during insertion. Another possible solution is that the flexible, double folded strip 4 before insertion into the glass bulb 2 forms a loop shape 18 having a cross section being larger than the open end 8 of the glass bulb 2. During insertion into the glass bulb 2 via the open end 8 thereof, the loop shape 18 will be temporarily compressed as it passes the necked portion 7 of the open end 7 and thereafter expand to conform to and follow at least a portion of the interior surface 15 of the glass bulb 2.

The cap 6, well known from incandescent lamps, has the form of a hollow body with a screwed outer surface 19 to allow electrical connection to a socket (not disclosed). The cap 6 is made of an electrically conductive material. In the disclosed embodiment the cap 6 has the form of a conventional Edison cap, although it is to be understood that any cap may be used.

In the following a method of manufacturing a LED electric bulb 1 according to one embodiment of the invention will be discussed. Reference is made to FIGS. 3*a*-3*d* and the flow chart of FIG. 4. Starting with FIG. 3*a*, a light generating module 17 is provided 100 with two crisscrossing flexible, double folded strips 4 connected to a driver PCB 3. The flexible, double folded strips 4 are mounted to the driver PCB 3 with the electrical contacts 12 of the flexible strip 4 arranged in contact with the mating electrical contacts 13 on the driver PCB 3. Further, the driver PCB 3 is provided with a ring 20 to be discussed below. The ring 20 may be mounted to the driver PCB 3 before or after the mounting of the flexible, double folded strips 4.

Figure 3A:
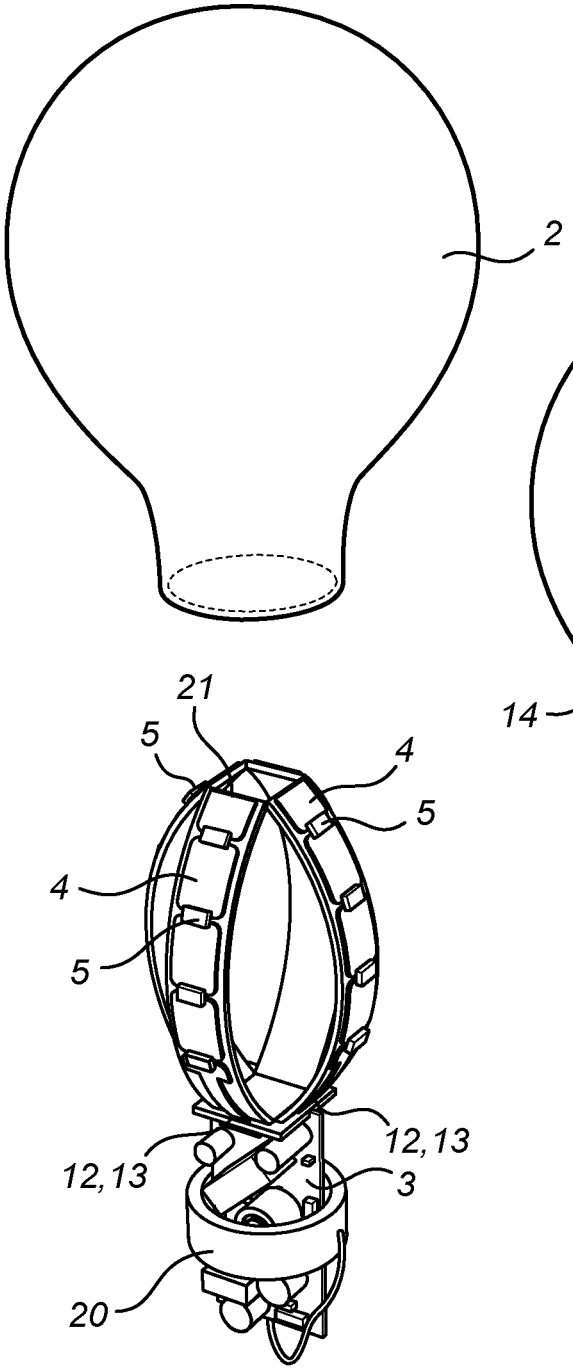
FIGS. 3*a*-3*d* schematically illustrate the steps of manufacturing a LED electric bulb according to the invention.
Figure 3B:
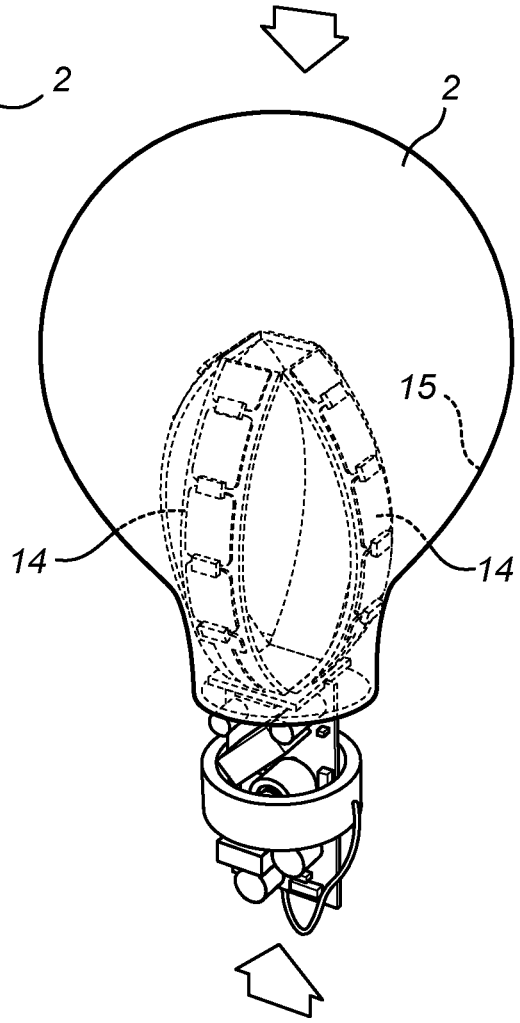
Figure 3C:
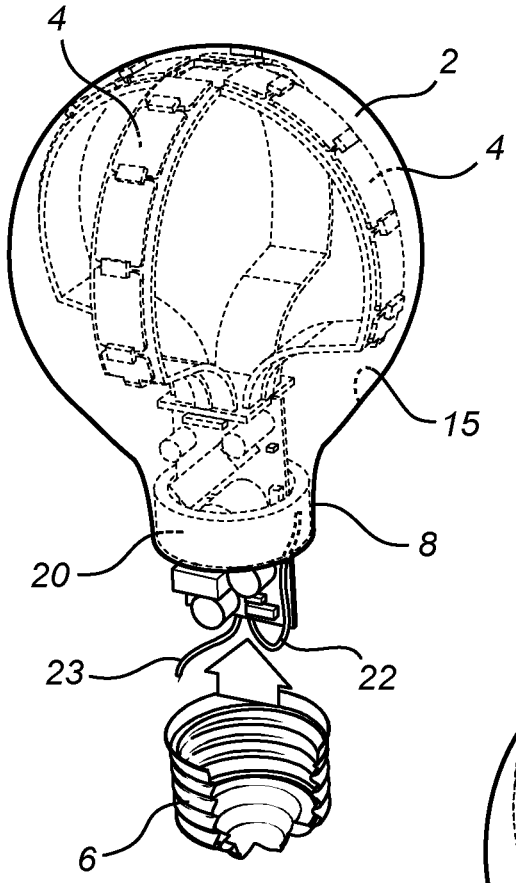
Figure 4:
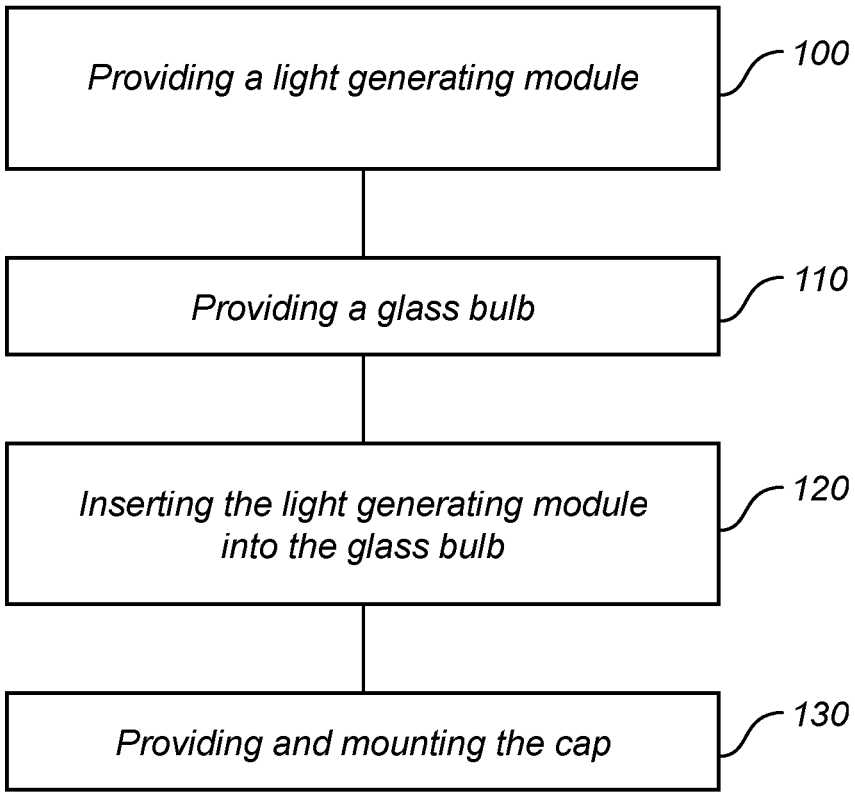
FIG. 4 is a flow chart illustrating the method of manufacturing a LED electric bulb according to the invention.

Now turning to FIGS. 3*b* and 3*c* the glass bulb 2 is provided and mounted 110; 120 to the light generating module by being lowered onto the flexible, double folded strips 4 in an uniaxial direction. During this movement the upper ends 21 of the flexible, double folded strips 4 will meet the interior surface 15 of the glass bulb 2 and during continued lowering of the glass bulb 2, the legs 14 of the flexible, double folded strips 4 will be pressed apart and conform to and follow at least a portion of the interior surface 15 of the glass bulb 2. The final result is illustrated in FIG. 3*c* in which the flexible, double folded strips 4 are fully inserted into the glass bulb 2 making close contact with the dome shaped interior surface 15 of the glass bulb 2.

Before or after mounting of the glass bulb 2, a first electrical contact wire 22 is provided between the ring 20 and the driver PCB 3. Also a second electrical contact wire 23 is arranged to extend between the driver PCB 3 and the cap 6 later to be mounted.

Figure 3D:
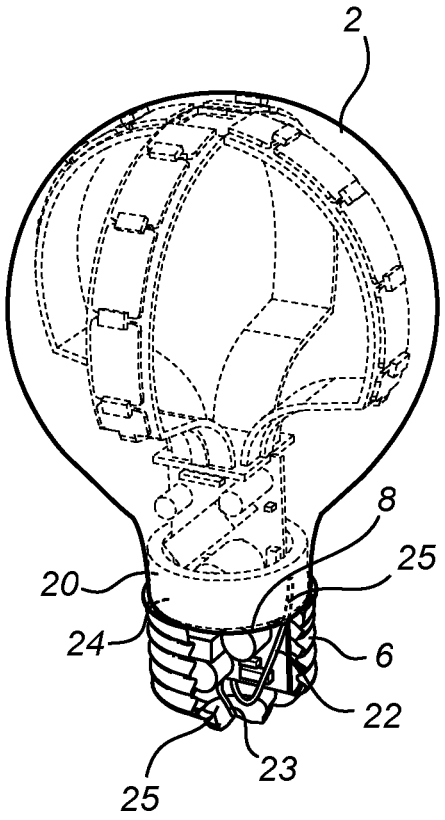

As disclosed in FIGS. 3*c* and 3*d*, the cap 6 is mounted 130 to the glass bulb 2 by being pressed towards the open end 8 of the glass bulb 2 to cover and close the same. To keep the two parts together, the cap 6 engages the ring 20 by forming a permanent joint 24. The permanent joint 24 may by way of example be provided by a snap-fit or an adhesive.

The cap 6 is mounted while applying heat to the cap 6 in order of providing soldered contacts 25 between the cap 6 and the second electrical contact wire 23 and between the ring 20 and the first electrical contact wire 22.

According to one aspect of the invention it relates to a method of producing a semi-finished LED electric bulb 26. The method and the semi-finished LED electric bulb 26 is illustrated with reference to FIGS. 5*a* and 5*b* and the flow chart of FIG. 6. The semi-finished LED electric bulb 26 comprises a glass bulb 2 provided with a flexible double folded strip 4 comprising a plurality of LED's 5 mounted therein.

Figure 5A:
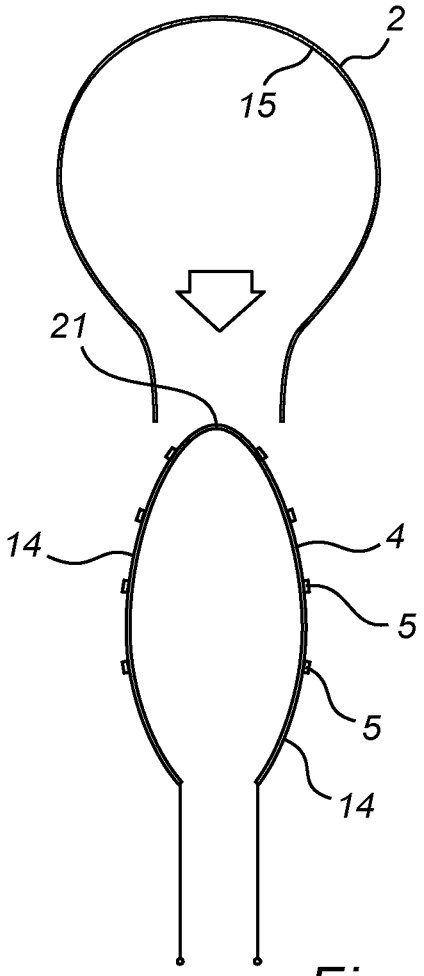
FIGS. 5*a*-5*c* schematically illustrate the semi-finished LED electric bulb and the method of producing the same.
Figure 6:
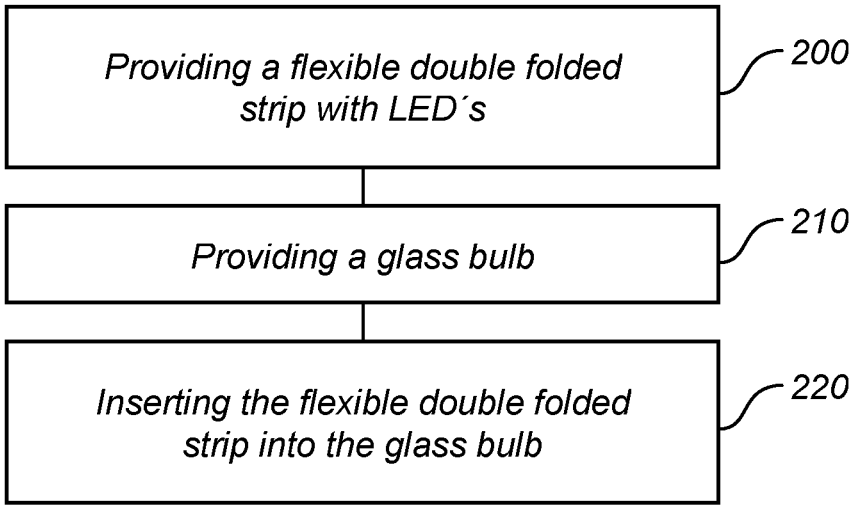
FIG. 6 is a flow chart illustrating the method of manufacturing a LED electric bulb according to the invention.

Starting with FIG. 5*a*, a glass bulb 2 and a flexible, double folded strip 4 provided with a plurality of LED's 5 is provided 200; 210.

Figure 5B:
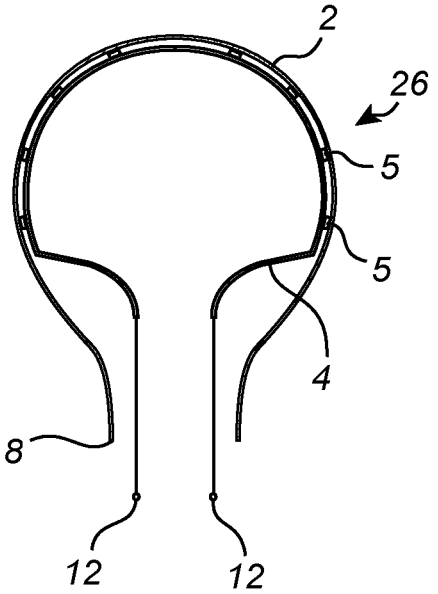

The flexible, double folded strip 4 is inserted 220 into the glass bulb 2 by lowering the glass bulb 2 onto the flexible, double folded strip 4. During this movement the upper end 21 of the flexible double folded strip 4 will meet the interior surface 15 of the glass bulb 2 and during continued lowering of the glass bulb 2, the legs 14 of the flexible, double folded strip 4 will be pressed apart and conform to and follow at least a portion of the interior surface 15 of the glass bulb 2. The final result is illustrated in FIG. 5*b*.

To allow later mounting of the semi-finished LED electric bulb 26 to a driver PCB and a cap, the electrical contacts 12 of the flexible, double folded strip 4 are accessible via the open end 8 of the glass bulb 2.

The thus semi-finished LED electric bulb 26 may be produced in one production site for later assembly with a driver PCB and a cap to thereby form a LED electric bulb.

Figure 5C:
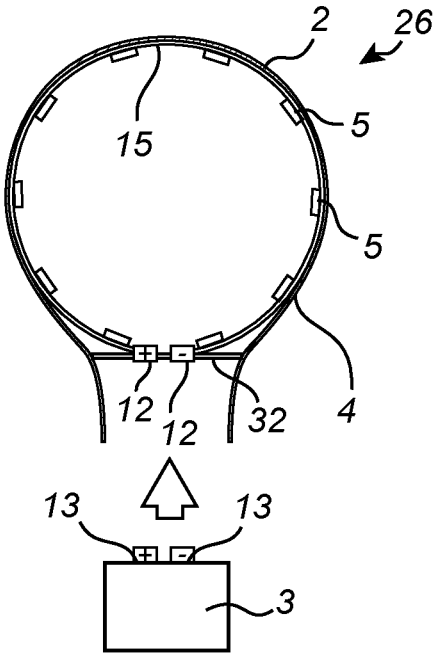

Yet another embodiment of a semi-finished LED electric bulb 26 is disclosed in FIG. 5*c* in which the flexible, double folded strip 4 has a loop shape extending more or less 360 degrees along the interior surface 15 of the glass bulb 2. In the disclosed embodiment, the flexible, double folded strip 4 is clamped to the interior surface 15 of the glass bulb 2 by a disc 32 which is inserted into the glass bulb 2. To allow insertion of the of the disc 32 into the glass bulb 2, and also to allow clamping of the flexible, double folded strip 4 to the glass bulb, the disc is made of a deformable material. The disc 32 may be made of a reflective material on the surface intended to face the interior of the glass bulb 2. Further, the disc 32 may be provided with electrical contacts 12 to allow connection to corresponding mating electrical contacts 13 on the driver PCB 3 later to be connected thereto.

Figure 7B:
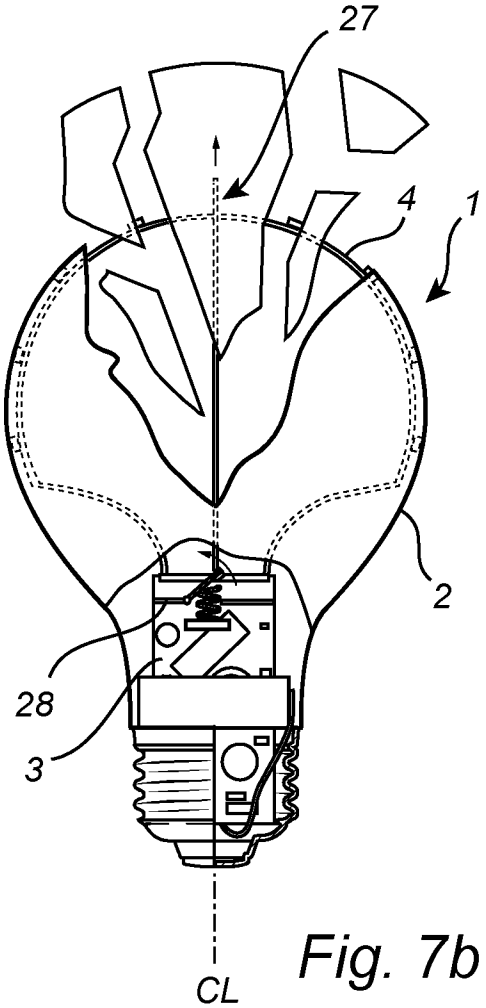
FIGS. 7*a* and 7*b* schematically illustrate one embodiment of a switch arrangement to be used in the LED electric bulb.
Figure 7A:
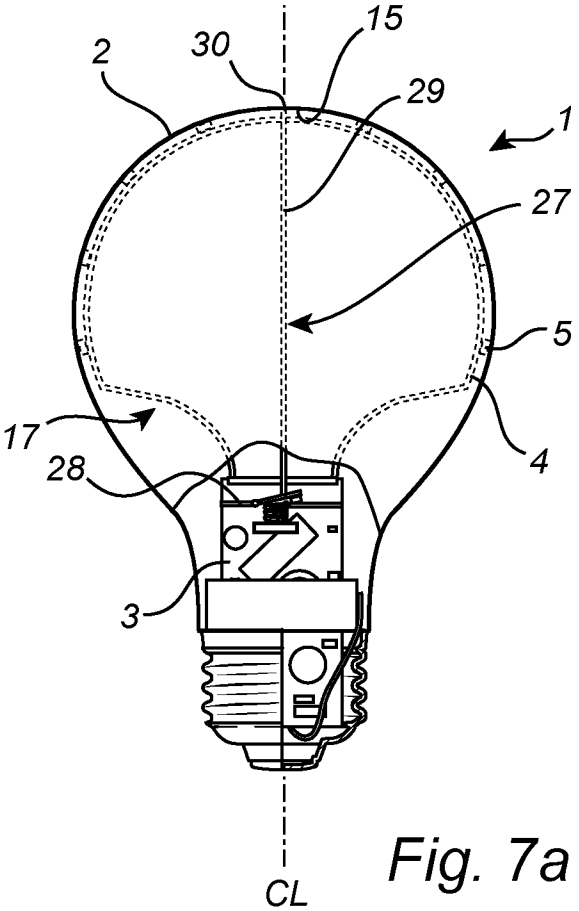

As a safety measure in case the glass bulb should break during use, the LED electric bulb 1 may be provided with a switch arrangement 27 disclosed with reference to FIGS. 7*a* and 7*b*.

The overall design of the LED electric bulb 1 is the same as that previously disclosed with reference to FIG. 1, and to avoid undue repetition reference is made to the previous discussion.

The switch arrangement 27 comprises a push-button switch 28 arranged on the driver PCB 3 interacting with a needle 29 extending between the push button switch 28 and an interior surface 15 of the glass bulb 2. In a fully working LED electric bulb 1, see FIG. 7*a*, the needle 29 is arranged to extend between the interior surface 15 of the glass bulb 2 and the push-button switch 28 pressing down the same, whereby a closed electrical circuit is provided for on the driver PCB to allow powering of the LED's 5. Should the glass bulb 2 break, see FIG. 7*b*, the needle 29 will release its pressure on the push-button switch 28 whereby the electrical circuit power-supplying the LED's 5 will be broken.

In the disclosed embodiment the needle 29 extends from the driver PCB 3 to a center point 30 of the dome shaped bulb coinciding with the longitudinal centerline CL of the glass bulb 2. Thereby the longitudinal extension of the needle 29 coincides with the mounting direction of the flexible strip 4 or the light generating module 17 versus the bulb 2 allowing an uniaxial mounting.

It is to be understood that the switch arrangement 27 may form a part of a semi-finished LED electric bulb.

Now turning to FIGS. 9*a*-9*e* the mounting of a second embodiment of the LED electric bulb 1 is disclosed. The mounting is initiated by providing, see FIG. 9*a*, a glass bulb 2, a flexible, double folded strip 4 with a plurality of LED's 5, a driver PCB 3, a cap 6 and a ring 20. In the disclosed embodiment two flexible double folded strips 4 are mounted in crisscross to the disc 32.

Figures 9A, 9B, 9C, 9D, 9E:
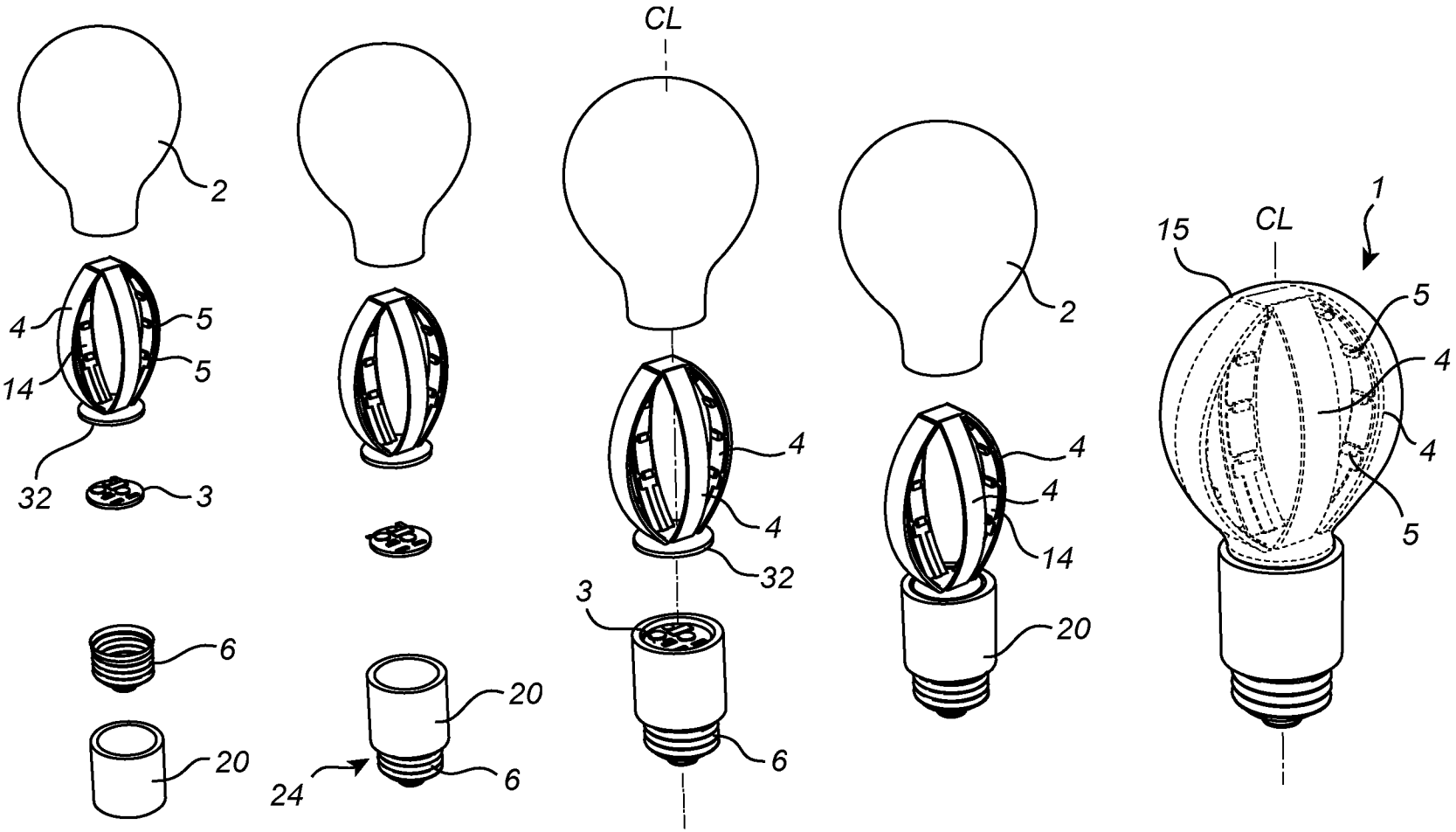
FIGS. 9*a*-9*e* disclose the steps of mounting one embodiment of the LED electric bulb.

During the mounting, the cap 6 is inserted into the ring 20, see FIG. 9*b*. To keep the two parts together, the cap 6 engages the ring 20 by forming a permanent joint 24. The permanent joint 24 may by way of example be provided by a snap-fit or an adhesive.

Next, see FIG. 9*c*, the driver PCB 3 is mounted into the cap 6. It is to be understood that during this mounting electrical connections (not disclosed) between the cap 6 and the driver PCB 3 are arranged for.

Next, see FIGS. 9*c* and 9*d*, disc 32 with the flexible, double folded strips 4 is connected to the driver PCB 3. The major surface of the disc 32 and the driver PCB 3 are oriented perpendicular to the longitudinal centerline CL of the LED electric bulb to be formed. During this step, it is understood that electrical contacts (not disclosed) on the flexible double folded strip 4 or on the disc 32 and corresponding electrical contacts (not disclosed) on the driver PCB 3 are arranged in communication with each other.

Finally, see FIGS. 9*d* and 9*e*, the glass bulb 2 is mounted and locked to the ring 20. The glass bulb 2 can be mounted to the ring 20 by using e.g. an adhesive or a snap-fit. While mounting the glass bulb 2, the legs 14 of the flexible, double folded strip 4 will be pressed apart and conform to and follow at least a portion of the interior surface of the glass bulb 2. The result is a LED electric bulb 1 with the flexible, double folded strips 4 forming a meridian crisscrossing pattern with LED's 5 extending 360 degrees along the interior surface 15 of the glass bulb 2. All parts are mounted in an uniaxial direction along the longitudinal centerline CL of the LED electric bulb 1.

As noted from FIGS. 3*a*-3*d* and 9*a*.9*e*, the ring 20 may be arranged either on the inside or on the outside of the glass bulb 2.

The person skilled in the art realizes that the present invention by no means is limited to the preferred embodiments described above. On the contrary, many modifications and variations are possible within the scope of the appended claims. For example, the glass bulb may be filled with dry air or an inert gas, such as nitrogen, to prevent moisture or dust from entering the interior of the lamp. In case of such embodiment it is to be understood that an air-/gas tight sealing must be provided between the cap and the glass bulb and that the ring may provide for such air-/gas tight sealing.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. Method of producing a LED electric bulb, comprising:

providing a light generating module comprising a driver PCB and a flexible, double folded strip forming two opposite legs comprising a plurality of LED's, providing a glass bulb having an open end, inserting the light generating module into the glass bulb via the open end thereof, with the flexible, double folded strip extending into the interior of the glass bulb whereby the two opposite legs are pressed apart to conform to and closely contact at least a portion of an interior surface of the glass bulb as the flexible, double folded strip is inserted into the glass bulb meeting the interior surface thereof, providing a cap closing the open end of the glass bulb, and providing a switch arrangement comprising a push-button switch arranged on the driver PCB and a needle extending between the push-button switch and the interior surface of the glass bulb.

2. Method of producing a LED electric bulb according to claim 1, wherein the light generating module before or during insertion into the glass bulb has a cross section smaller than the cross section of the open end of the glass bulb.

3. Method of producing a LED electric bulb according to claim 1, wherein the cap is provided to close the open end of the glass bulb by engaging a ring on the light generating module.

4. Method of producing a LED electric bulb according to claim 1, wherein the flexible, double folded strip has a length exceeding the longitudinal extension of the glass bulb as seen along the longitudinal centerline thereof, wherein the flexible, double folded strip is forced to contact at least a portion of the interior surface of the glass bulb as the flexible, double folded strip is inserted into the glass bulb meeting the interior surface thereof.

5. Method of producing a LED electric bulb according to claim 1, wherein the flexible, double folded strip is arranged to conform to and contact a portion of the interior surface of the glass bulb corresponding to an angle of least 90 degrees of the dome shaped geometry of the glass bulb as seen in a plane coinciding with the longitudinal centerline of the bulb.

6. Method of producing a semi-finished LED electric bulb, comprising providing a flexible, double folded strip forming two opposite legs comprising a plurality of LED's, providing a glass bulb having an open end, inserting the flexible, double folded strip into the glass bulb via the open end thereof, whereby the two opposite legs are pressed apart to conform to and closely contact at least a portion of an interior surface of the glass bulb as the flexible, double folded strip is inserted into the glass bulb meeting the interior surface thereof, and providing a switch arrangement comprising a push-button switch arranged on the driver PCB and a needle extending between the push-button switch and the interior surface of the glass bulb.

7. Method of producing a semi-finished LED electric bulb according to claim 6, wherein the flexible, double folded strip is clamped to the interior surface of the glass bulb by a disc inserted into the glass bulb.

8. Method of producing a semi-finished LED electric bulb according to claim 6, wherein the flexible, double folded strip comprises electrical contacts accessible via the open end of the glass bulb when the flexible, double folded strip is inserted in the glass bulb.

9. Method of producing a semi-finished LED electric bulb according to claim 6, wherein the flexible, double folded strip is arranged to conform to and contact a portion of the interior surface of the glass bulb corresponding to an angle of least 90 degrees of the dome shaped geometry of the glass bulb as seen in a plane coinciding with the longitudinal centerline of the glass bulb.

10. Use of a semi-finished LED electric bulb according to claim 6 for the production of a LED electric bulb.

11. LED electric bulb, comprising a glass bulb, a cap and a light generating module at least partly received inside the glass bulb and being in electrical contact with the cap, wherein the light generating module comprises a driver PCB and a flexible, double folded strip forming two opposite legs comprising a plurality of LED's, whereby the two opposite legs are pressed apart and conforming to and closely contacting at least a portion of an interior surface of the glass bulb, and a switch arrangement comprising a push-button switch arranged on the driver PCB and a needle extending between the push-button switch and the interior surface of the glass bulb.

12. LED electric bulb according to claim 11, wherein the flexible, double folded strip has a length exceeding the longitudinal extension of the glass bulb as seen along the longitudinal centerline thereof.

* * * * *